US007036567B2

(12) United States Patent
Shimanuki et al.

(10) Patent No.: US 7,036,567 B2
(45) Date of Patent: May 2, 2006

(54) HEAT EXCHANGER FOR COOLING AIR

(75) Inventors: Hiroyasu Shimanuki, Kariya (JP); Eiichi Torigoe, Anjo (JP); Masamichi Makihara, Gamagori (JP)

(73) Assignee: DENSO Corporation, Kariya (JP)

( * ) Notice: Subject to any disclaimer, the term of this patent is extended or adjusted under 35 U.S.C. 154(b) by 269 days.

(21) Appl. No.: 10/623,346

(22) Filed: Jul. 18, 2003

(65) Prior Publication Data

US 2004/0016535 A1 Jan. 29, 2004

(30) Foreign Application Priority Data

Jul. 19, 2002 (JP) ..... 2002-211218

(51) Int. Cl.
*F28D 1/04* (2006.01)

(52) U.S. Cl. ..... 165/110; 165/173

(58) Field of Classification Search ..... 165/172, 165/173, 175, 231, 110, 913, DIG. 192; 62/150, 62/272, 285, 288, 289–291
See application file for complete search history.

(56) References Cited

U.S. PATENT DOCUMENTS 677,876 A * 7/1901 Martin ..... 165/110
2,099,665 A * 11/1937 Smith ..... 62/272
2,133,354 A * 10/1938 Krackowizer ..... 62/290
4,924,939 A * 5/1990 Kim ..... 165/172
5,141,048 A * 8/1992 Sausner ..... 165/110
5,152,337 A 10/1992 Kawakatsu et al.
5,341,870 A * 8/1994 Hughes et al. ..... 165/110
5,470,431 A 11/1995 Okuda et al.
5,481,886 A * 1/1996 Hasegawa et al. ..... 62/285
5,514,248 A 5/1996 Okuda et al.
5,800,673 A 9/1998 Okuda et al.
6,286,589 B1 * 9/2001 Uehara ..... 165/166
6,796,368 B1 * 9/2004 Saida et al. ..... 62/272
2004/0035559 A1 * 2/2004 Ko et al. ..... 165/110

FOREIGN PATENT DOCUMENTS

JP 63-271099 * 11/1988
JP U-5-52581 7/1993
JP A-5-332697 12/1993
JP A-8-145580 6/1996
JP 2001-050686 2/2001

* cited by examiner

*Primary Examiner*—Teresa J. Walberg
(74) *Attorney, Agent, or Firm*—Harness, Dickey & Pierce, PLC

(57) ABSTRACT

In a heat exchanger for cooling air, tubes are disposed vertically and header tanks are connected to the ends of the tubes. The lower side header tank is formed with drains, which are depressions, at positions between the tubes so that condensed water, which accumulates on the lower side header tank, drains away through the drains. Each of the drains has substantially a V-shaped cross-section to facilitate drainage of the water.

20 Claims, 6 Drawing Sheets

HEAT EXCHANGER FOR COOLING AIR

CROSS REFERENCE TO RELATED APPLICATION

This application is based on Japanese Patent Application No. 2002-211218 filed on Jul. 19, 2002, the disclosure of which is incorporated herein by reference.

FIELD OF THE INVENTION

The present invention relates to a heat exchanger having tubes and header tanks, which is suitable for an evaporator for a vapor compression refrigerant cycle system.

BACKGROUND OF THE INVENTION

An evaporator for a vapor compression refrigerant cycle system generally has a plurality of tubes and header tanks communicating with the tubes. The tubes are arranged vertically and the header tanks are connected to the top ends and bottom ends of the tubes. This kind of evaporator is for example disclosed in JP-A-2001-50686.

Incidentally., in a heat exchanger for cooling air, such as the evaporator, moisture condenses on surfaces of the tubes and fins, which are disposed between the tubes. In a case that the tubes are arranged vertically, the condensed water flows downwardly along the tube surfaces. Further, the condensed water is likely to accumulate around the lower position of the heat exchanger.

SUMMARY OF THE INVENTION

The present invention is made in view of the foregoing matter and it is an object of the present invention to provide a heat exchanger for cooling air with enhanced drainage of condensed water.

According to the present invention, a heat exchanger for cooling air includes tubes through which fluid flows, fins provided between tubes for increasing areas of heat-transfer surfaces, and a header tank. The tubes are arranged vertically and bottom ends of the tubes are connected to the header tank. The header tank is formed with drains, which are depressions, at positions between the tubes. The drains downwardly direct water that accumulates between the tubes.

Accordingly, condensed water, which flows downwardly and accumulates at lower positions of the tubes, drains away through the drains. Preferably, each of the depressions narrows toward its bottom, thereby facilitating drainage of the condensed water.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Embodiments of the present invention will be described with reference to drawings.

Figure 1A:
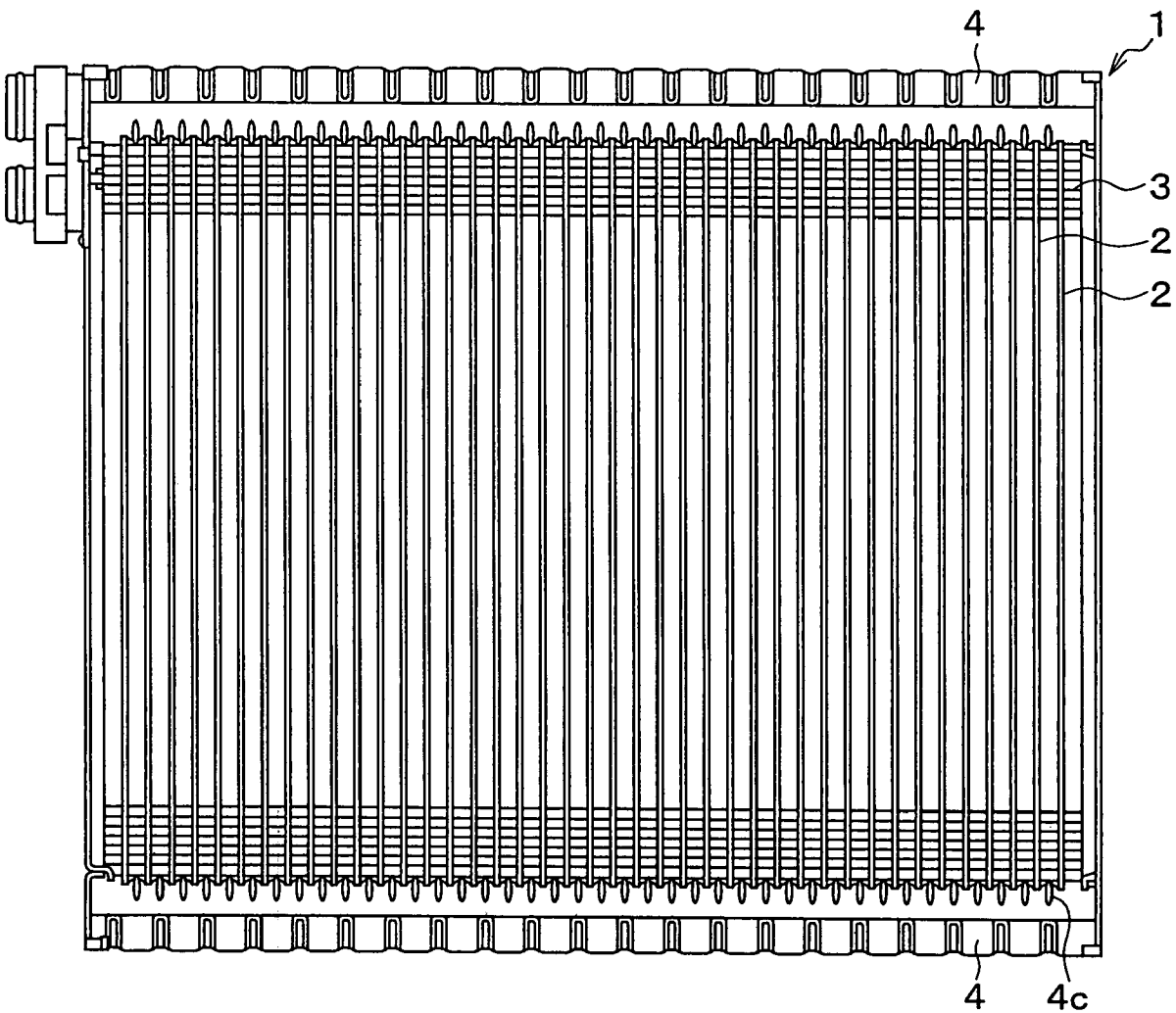
FIG. 1A is a plan view of an evaporator according to the first embodiment of the present invention.
Figure 1B:
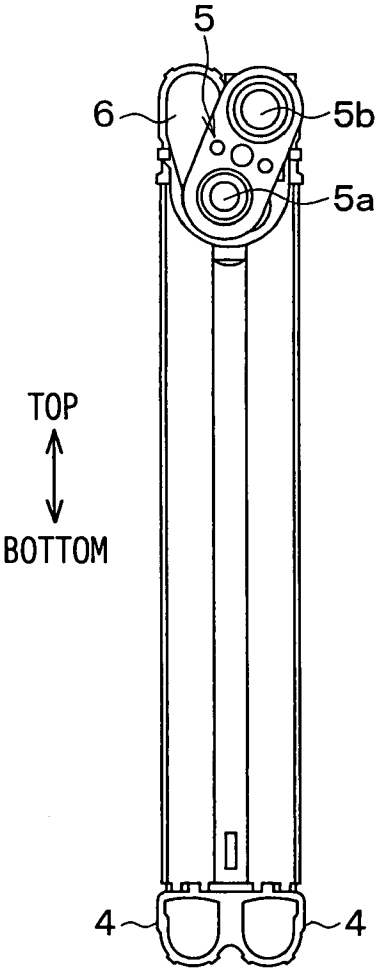
FIG. 1B is an end view of the evaporator according to the first embodiment of the present invention.

In the first embodiment, a heat exchanger for cooling air is employed to an evaporator of a vapor compression refrigerant cycle system. As shown in FIGS. 1A and 1B, the evaporator 1 includes a plurality of flat tubes 2 through which refrigerant flows, corrugated fins 3 and header tanks 4.

The corrugated fins 3 are joined to outer surfaces of the tubes 2 for increasing areas of heat-transfer surfaces. The tubes 2 are arranged vertically. The header tanks 4 are connected to top and bottom ends of the tubes 2.

Figure 2:
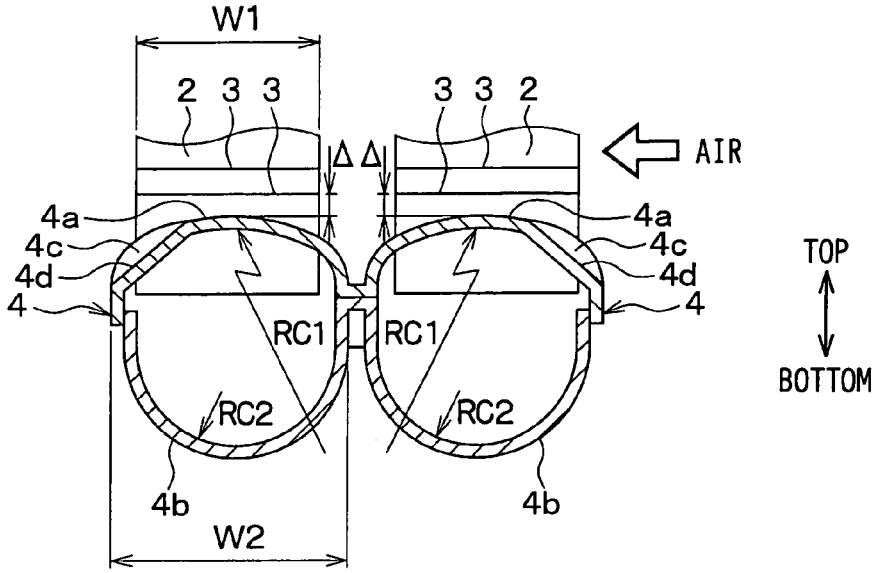
FIG. 2 is a cross-sectional view of a header tank of the evaporator according to the first embodiment of the present invention.

The tubes 2 and the fins 3 are alternately stacked and construct a core portion for performing heat exchange. In the embodiment, the evaporator 1 has two core portions. The core portions are arranged parallel with respect to an air flow direction, as shown in FIGS. 1B and 2.

A connecting block 5 is joined to an end of one of the header tanks 4. The connecting block 5 connects the evaporator 1 to a box-type expansion valve, which includes a temperature sensor for detecting superheat of the refrigerant discharging from the evaporator 1 and an expansion valve for decompressing the refrigerant. An inlet port of the block 5 connects to an outlet side of the expansion valve. An outlet port 5*b* of the block 5 connects to an inlet side of the temperature sensor.

Each of the header tanks 4 is constructed by joining a core plate 4*a* into which tubes 2 are inserted and a tank plate 4*b* that forms a tank space through which the refrigerant flows. In this embodiment, each header tank 4 forms two tank spaces (air upstream side space and air downstream side space), as shown in FIG. 2.

The core plate 4*a* has a radius of curvature RC1 that is greater than a radius of curvature RC2 of the tank plate 4*b*, so the core plate 4*a* is flatter than the tank plate 4*b*. This is to increase a surface area of the core portion, that is, the length of the core portion exposed to the air, without an increase in an overall size of the evaporator 1.

Figure 3:
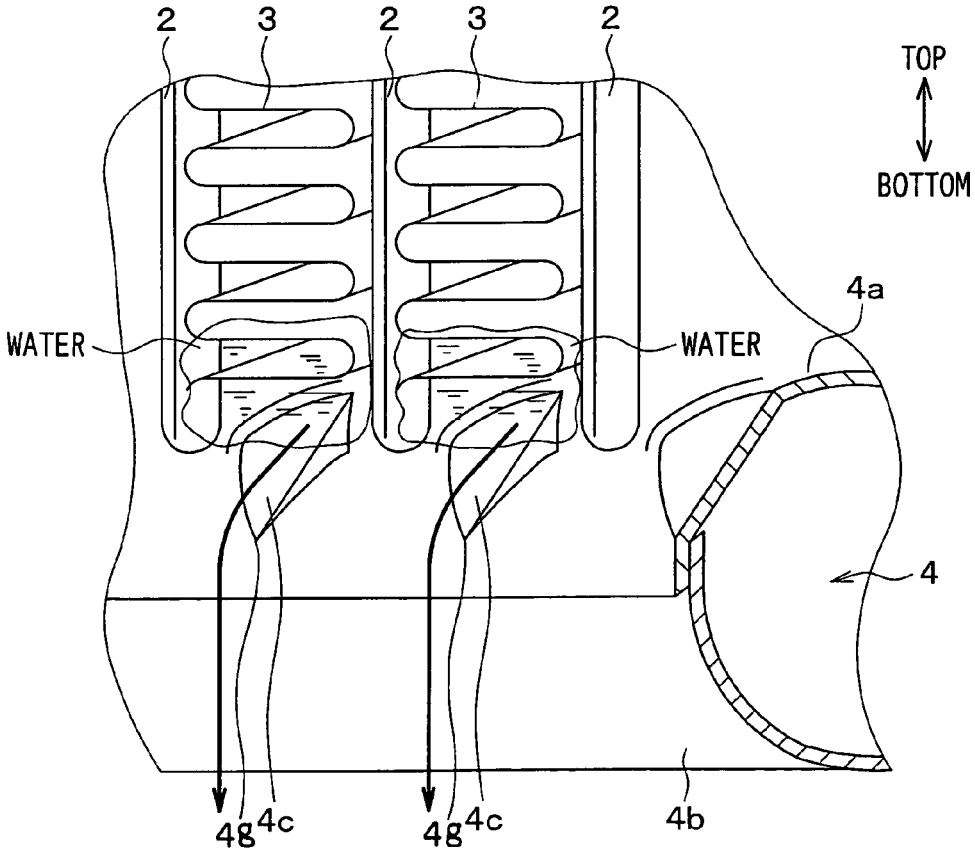
FIG. 3 is an enlarged perspective view of the lower side of the evaporator according to the first embodiment of the present invention.

As shown in FIGS. 2 and 3, the header tank 4 is formed with drains 4*c*, which are depressions, at positions between the tubes 2. The drains 4*c* downwardly directs water that accumulates between the tubes 2.

Specifically, the bottom 4*d* of the drain 4*c* is sloped downward in a direction away from the tube 2, as shown in FIG. 2. Also, the drain 4*c* is formed such that it has substantially a diamond shape when viewed from the top, that is, viewed along the longitudinal direction of the tubes 2. (See FIG. 3)

The core plate 4*a* is pressed by a press die having a wedge shape, so that the drain 4*c* has substantially a V-shaped cross-section when viewed along the longitudinal direction of the bottom 4*d*. As shown in FIG. 4, the dimension (width) W3 of the drain 4*c* reduces toward the bottom 4*d*.

In the embodiment, the tubes 2, fins 3 and header tanks 4 are made of aluminum and integrally joined by brazing.

Next, advantageous effects of the embodiment will be described.

Because the tubes 2 are vertically arranged, condensed water flows downwardly along the surfaces of the tubes 2 and collects around the lower position of the core portion adjacent to the header tank 4. The water easily accumulates involved spaces where the fin 3 and the tube 2 are joined adjacent to the core plate 4*a*. In the embodiment, the drains 4*c* are formed in such involved spaces between the tubes 2. Therefore, the water drains away through the drains 4*c*.

According to LaPlace's equation (see, e.g. *Surface Tension*, Shu Ono, Kyoritsu Press.), an internal pressure P of the water accumulated in the V-shaped drain 4*c* and a radius R of curvature of the surface of the water have a following relationship.

$$P=-a/R+b$$

Here, "a" and "b" are proportionality constants. The right side of the equation has "−" sign because the pressure is lower than atmospheric pressure, that is, negative pressure.

According to the above equation, the smaller the radius R of curvature of the surface of the water is, the lower the pressure P is. That is, the smaller the radius R of curvature is, the more the gap between a difference between the atmospheric pressure and the negative pressure increases.

Figure 4A:
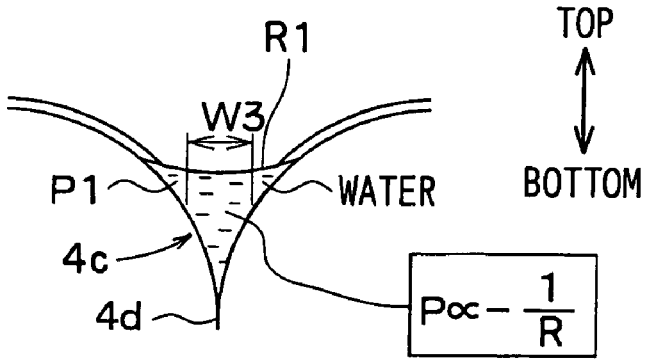
FIGS. 4A to 4C are explanatory views for explaining drainage of condensed water in the evaporator according to the first embodiment of the present invention.
Figure 4B:
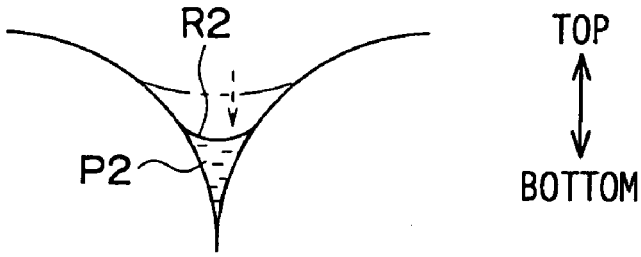

When the water accumulates in the drain 4*c* to a predetermined amount as shown in FIG. 4A, it flows out of the drain 4*c* through a lowest end 4*g* (FIG. 3) of the drain 4*c* by its gravity force as shown in FIG. 4B. With this, the radius R of curvature of the water surface reduces from the state shown in FIG. 4A to the state shown in FIG. 4B (R1>R2). Also, because the radius R (R2) reduces, the internal pressure P of the condensed water reduces (P1>P2).

Figure 4C:
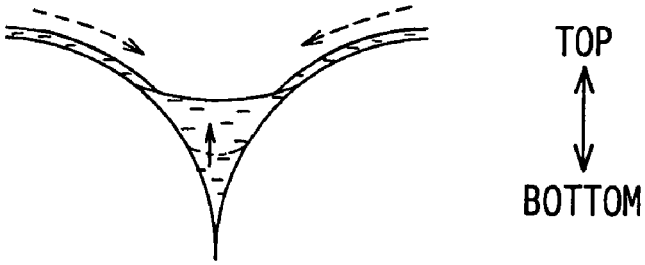

As a result, the water in the drain 4*c* draws water (water film) around the drain 4*c* into the drain 4*c* as shown by dotted arrows in FIG. 4C, so the radius R of curvature of the water surface increases again to the state shown in FIG. 4C.

Because draining and drawing of the water are repeated in the order shown in FIGS. 4A, 4B, and 4C, the condensed water is effectively discharged.

Figure 5A:
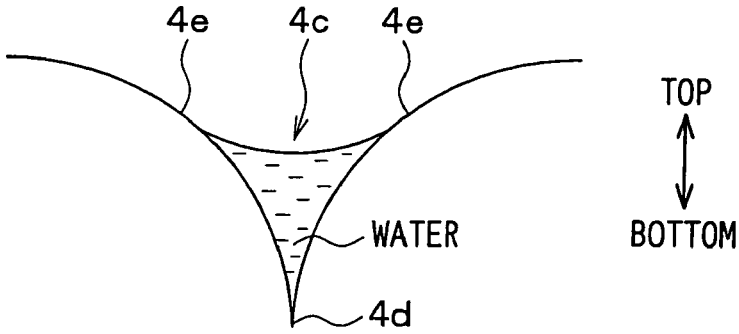
FIGS. 5A to 5C are schematic views for showing examples of shapes of drains formed on the evaporator according to the first embodiment of the present invention.
Figure 5B:
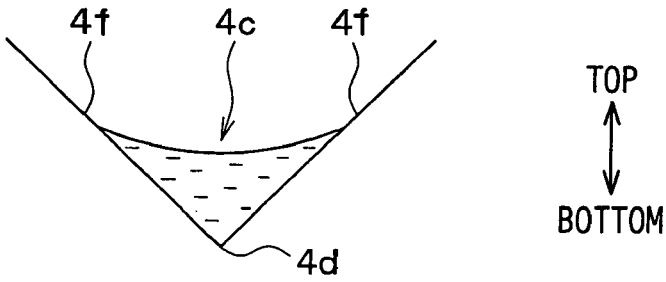
Figure 5C:
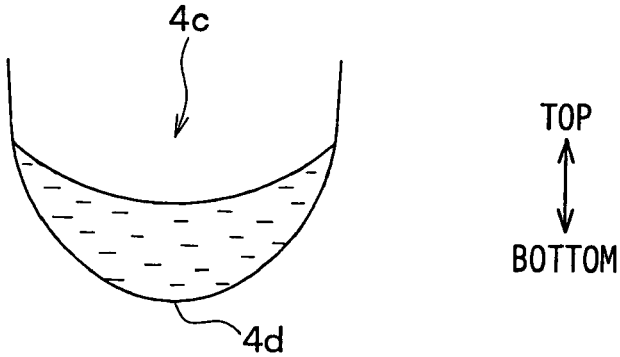

FIGS. 5A to 5C show examples of V-shapes of the drain 4*c*, the width of which reduces toward its bottom. In the embodiment, the V-shapes shown in FIGS. 5A and 5B are preferable for the drains 4*c*. In FIG. 5A, the drain 4*c* is formed by curved walls 4*e* protruding inward. In FIG. 5B, the drain 4*c* is formed by flat walls 4*f*.

Since the drain 4*c* has substantially the diamond shape when viewed from the top, the lowest end 4*g* of the drain 4*c* is in acute angle. Thus, the drain 4*c* has the substantially V-shaped cross-section also at its lowest position. Accordingly, the condensed water can continuously drain away.

The condensed water adheres to the surface of the fin 3 by surface tension. Therefore, it is preferable that a minimum distance Δ (FIG. 2) between the header tank 4 and the fin 3 in the vertical direction is in a range between equal to or greater than 0 mm and equal to or less than 1.0 mm, so that the condensed water adhering on the fins 3 can flow into the drain 4*c* by capillary action. Here, when the minimum distance Δ is 0 mm, the fin 3 contacts the header tank 4.

Since the ends of the tubes 2 are inserted in the header tank 4, a dimension (width) W1 of the tube 2 is smaller than a dimension (width) W2 of the header tank 4 minus two times thicknesses of the wall of the header tank 4, with respect to the air flow direction, as shown in FIG. 2. That is, the width W1 of the tube 2 is smaller than an inside width of the header tank 4. Further, the core plate 4*a* is substantially flat. In the evaporator having the above structure, the condensed water easily accumulates on the lower side header tank 4. In the embodiment, the condensed water is effectively drained away through the drains 4*c* of the header tank 4.

Figure 6A:
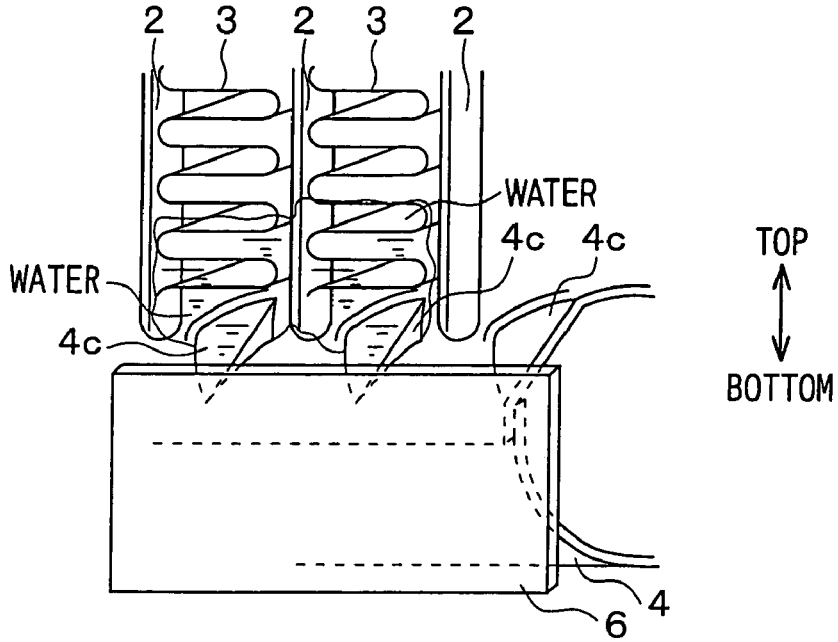
FIG. 6A is a perspective view of the lower side of an evaporator according to the second embodiment of the present invention.
Figure 6B:
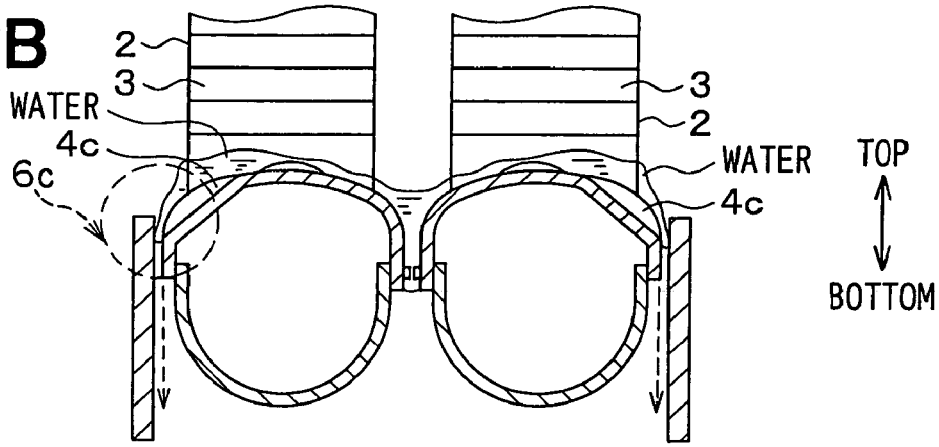
FIG. 6B is a cross-sectional view of the lower side of the evaporator according to the second embodiment of the present invention.
Figure 6C:
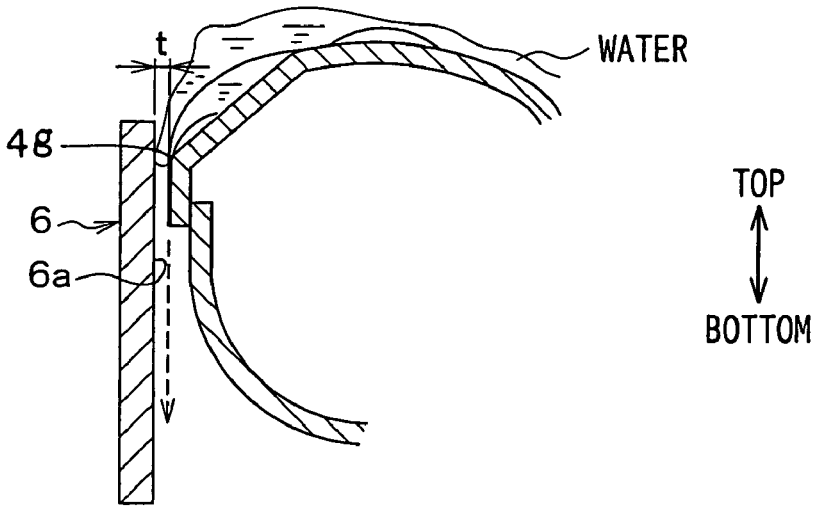
FIG. 6C is a partial enlarged view of the evaporator shown in FIG. 6B.

In the second embodiment, the evaporator 1 is provided with plates (drainage facilitating member) 6, as shown in FIGS. 6A to 6C. The plate 6 is disposed such that a surface 6*a* opposes the header tank 4 and is spaced from the lowest end 4*g* of the drain 4*c* by a predetermined distance T.

The water reaches the lowest end 4*g* of the drain 4*c* and contacts the surface 6*a*. As a result, the water flows along the surface 6*a* as shown by a dotted arrow in FIG. 6*c*. Accordingly, the plates 6 facilitate drainage of water from the drains 4*c*. Preferably, the distance T is in a range between equal to or greater than 0 mm and equal to or less than 1.0 mm. The drainage-facilitating member 6 is not limited to the form of plate, as long as having the surface 6*a*.

Figure 7:
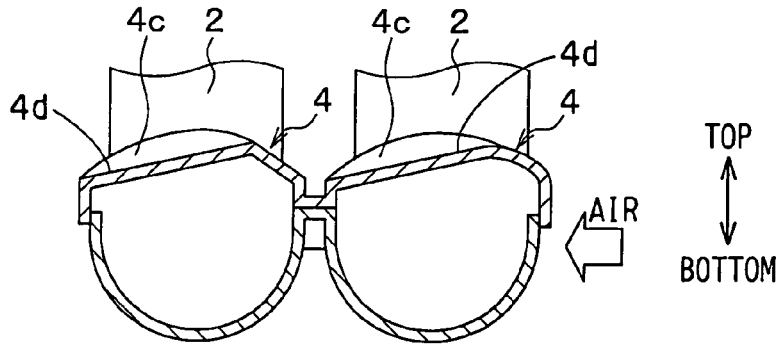
FIG. 7 is a cross-sectional view of a header tank of an evaporator according to the third embodiment of the present invention.

In the third embodiment, the bottoms 4*d* of the drains 4*c* are sloped downwardly with respect to the air flow direction, as shown in FIG. 7. An air downstream position of the bottom 4*d* is lower than an air upstream position. Also in the third embodiment, the evaporator 1 provides advantages similar to those of the first embodiment.

Figure 8:
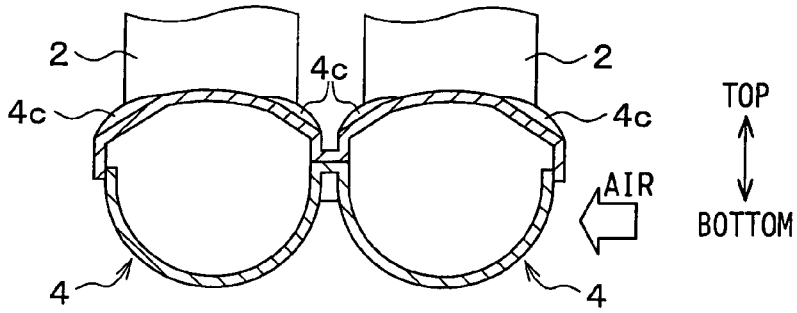
FIG. 8 is a cross-sectional view of a header tank of an evaporator according to the fourth embodiment of the present invention.

In the fourth embodiment, the drains 4*c* are formed on the header tank 4 at the air upstream positions and the air downstream positions of the respective core portions, as shown in FIG. 8. Also in the fourth embodiment, the evaporator 1 provides advantages similar to those of the first embodiment.

Figure 9:
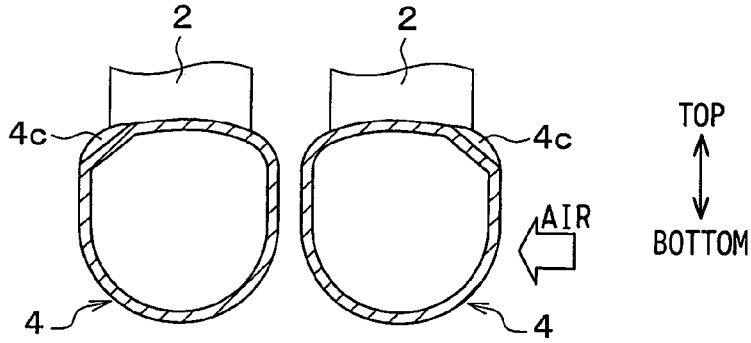
FIG. 9 is a cross-sectional view of a header tank of an evaporator according to the fifth embodiment of the present invention.

In the fifth embodiment, the header tank 4 is integrally formed such as by extrusion and drawing, as shown in FIG. 9. The drains 4*c* are formed in the manner similar to the first to the fourth embodiments. Thus, also in the fifth embodiment, the evaporator 1 provides advantages similar to those the above embodiments.

In the first embodiment, the single header tank 4 integrally forms two tank spaces therein. The first space is for the air upstream side core portion and the second space is for the air downstream side core portion. However, the first and the second tank spaces can be provided by separate header tanks.

Figure 10:
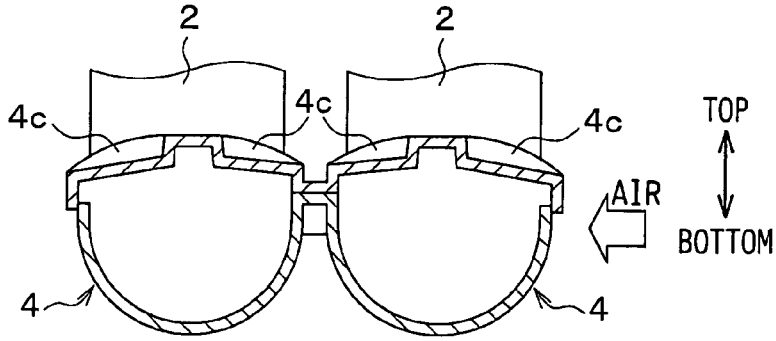
FIG. 10 is a cross-sectional view of a header tank of an evaporator according to another modified embodiment of the present invention.

The cross-sections of the header tanks 4 are not limited to those of the above-described embodiments. For example, the header tank 4 can have a cross-section shown in FIG. 10.

The present invention is not limited to the evaporator, which cools air with latent heat of vaporization of the refrigerant. The present invention can be employed to a heat exchanger that cools air with sensible heat without changing phase of the refrigerant.

The present invention should not be limited to the disclosed embodiments, but may be implemented in other ways without departing from the spirit of the invention.

What is claimed is:

1. A heat exchanger for cooling air comprising:

tubes through which fluid flows, wherein the tubes are arranged vertically;

fins provided between the tubes; and a header tank formed with slot openings and drains, wherein the end of the tubes are inserted and brazed in the slot openings, the drains are depressions and disposed between adjacent slot openings. and each drain has a length in a direction parallel to a longitudinal direction of each slot opening to drain water accumulated between the tubes.

2. The heat exchanger according to claim 1, wherein each of the drains narrows toward its bottom.

3. The heat exchanger according to claim 1, wherein a bottom of each of the drains slopes downward from its air upstream position toward its air downstream position.

4. The heat exchanger according to claim 1, wherein a bottom of each of the drains slope downward in a direction away from the tubes.

5. The heat exchanger according to claim 1, wherein the drains have substantially diamond shapes when viewed in a direction substantially parallel to longitudinal directions of the tubes.

6. The heat exchanger according to claim 1, further comprising:

a member defining a surface for facilitating drainage of water, wherein the member is disposed such that the surface is opposed to the header tank and spaced from ends of the drains by a predetermined distance.

7. The heat exchanger according to claim 6, wherein the predetermined distance is in a range between equal to or greater than 0 mm and equal to or less than 1.0 mm.

8. The heat exchanger according to claim 1, wherein a minimum distance between the fin and the header tank is in a range between equal to or greater than 0 mm and equal to or less than 1.00 mm.

9. The heat exchanger according to claim 1, wherein the header tank has a first radius of curvature on a side adjacent to the tubes and a second radius of curvature on a side opposite to the tubes, wherein the first radius is larger than the second radius.

10. The heat exchanger according to claim 1, wherein the fluid is refrigerant.

11. A heat exchanger comprising:

a plurality of tubes through which fluid flows, being arranged vertically and parallel with each other; and a header tank connected to bottom ends of the tubes, which defines chamber communicated with inner passages in the tubes, wherein the header tank provides an upper wall on which the tubes are connected, side walls and a bottom wall, and the upper wall is partially deformed to define depressions located between the tubes, and the depressions are terminated at one of the side walls to drain water to the side wall through the depressions.

12. The heat exchanger according to claim 11, wherein the upper wall has a plurality of slot openings in which the tubes are inserted and brazed respectively.

13. The heat exchanger according to claim 11, wherein the header tank comprises:

a core plate (4*a*) providing the upper wall and the side walls; and a tank plate (4*b*) providing the bottom wall, wherein the depressions are terminated at one of lateral sides of the core plate (4*a*).

14. The heat exchanger according to claim 11, wherein the bottom wall is formed to define a surface smoother than the upper wall along a longitudinal direction of the header tank.

15. The heat exchanger according to claim 11, wherein the depressions are also terminated at the upper wall between the tubes.

16. The heat exchanger according to claim 11, wherein the depressions have lateral ends that are terminated at both of the side walls, respectively.

17. The heat exchanger according to claim 11, wherein the depressions are only formed on a lateral shoulder region of the header tank.

18. The heat exchanger according to claim 11, further comprising fins provided between the tubes.

19. The heat exchanger according to claim 1, wherein the header tank has a core plate and a tank plate joined to the core plate, and the slot openings and the drains are formed on the core plate.

20. The heat exchanger according to claim 1, wherein the header tank includes an upper wall, side walls, and a bottom wall, the drain has a first end and a second end, the first end is disposed on the upper wall between the tubes, and the second end is disposed on one of the side walls.

* * * * *